US009695561B2

(12) United States Patent
Godwin, Jr.

(10) Patent No.: US 9,695,561 B2
(45) Date of Patent: Jul. 4, 2017

(54) SNOW PLOW HAVING A PNEUMATIC LIFTING DEVICE FOR REDUCING THE WEAR ON THE BLADE OF THE SNOW PLOW

(71) Applicant: James Patrick Godwin, Jr., Dunn, NC (US)

(72) Inventor: James Patrick Godwin, Jr., Dunn, NC (US)

( * ) Notice: Subject to any disclaimer, the term of this patent is extended or adjusted under 35 U.S.C. 154(b) by 73 days.

(21) Appl. No.: 14/744,527

(22) Filed: Jun. 19, 2015

(65) Prior Publication Data

US 2016/0369463 A1 Dec. 22, 2016

(51) Int. Cl.
*E01H 5/06* (2006.01)

(52) U.S. Cl.
CPC ..... *E01H 5/061* (2013.01); *E01H 5/06* (2013.01); *E01H 5/063* (2013.01)

(58) Field of Classification Search
CPC E01H 5/06; E01H 5/062; E01H 5/063; E01H 5/066; E01H 5/061; E02F 9/24; E02F 9/226
See application file for complete search history.

(56) References Cited

U.S. PATENT DOCUMENTS 3,190,017 A * 6/1965 Rockwell ..... E02F 3/6436 172/491
3,238,647 A * 3/1966 Hall ..... B62D 49/04 172/248
3,808,714 A * 5/1974 Reissinger ..... E01H 1/105 172/269
3,883,965 A * 5/1975 Poirier, Sr. ..... E01H 5/063 172/816
4,307,523 A * 12/1981 Reissinger ..... E01H 5/06 37/232
4,680,880 A 7/1987 Boneta
5,044,098 A * 9/1991 Berghefer ..... E01H 5/06 267/249
5,265,356 A 11/1993 Winter
5,924,223 A * 7/1999 Hone, Jr. ..... E01H 5/06 37/231
6,123,156 A 9/2000 Dufour et al.
6,253,890 B1 7/2001 Hunter
6,324,775 B1 * 12/2001 Harnois ..... E02F 3/7645 172/781
6,581,306 B1 * 6/2003 DiClementi ..... E01H 5/063 248/565
6,792,704 B2 * 9/2004 Johnson ..... E01H 5/06 172/261
8,732,988 B2 * 5/2014 Hanson ..... E01H 5/062 37/244
2003/0101626 A1 6/2003 Johnson

* cited by examiner

*Primary Examiner* — Jamie L McGowan
(74) *Attorney, Agent, or Firm* — Coats and Bennett PLLC

(57) ABSTRACT

A snow plow lifting device is operatively connected to a snow plow for selectively imparting a lifting force on the snow plow. This lifting force reduces the effective weight of the snow plow bearing on an underlying surface such as a roadway. Thus, during a snow plowing operation, this reduces the wear on a lower edge of a blade that forms a part of the snow plow.

11 Claims, 5 Drawing Sheets

SNOW PLOW HAVING A PNEUMATIC LIFTING DEVICE FOR REDUCING THE WEAR ON THE BLADE OF THE SNOW PLOW

FIELD OF THE INVENTION

The present invention relates to snow plows.

BACKGROUND OF THE INVENTION

Snow plows include a blade that generally comprises a moldboard and, in many instances, a lower trip board is formed across the lower edge of the moldboard. The snow plow is pivotally connected to a push frame that is mounted to a vehicle or to another type of prime mover. A hydraulic cylinder and lift arm are typically operatively interconnected between the push frame and the snow plow. This allows the snow plow to be moved back and forth between a lower snow plowing position and a raised travel position.

Snow plows are typically heavy. When the lift arm is fully lowered, the trip board or the lower edge of the blade engages and rests on an underlying surface such as a roadway. Now the full weight of the snow plow is supported by the underlying surface. When the plow is operated in this state, there is typically a rapid wear on the trip board or the lower edge of the blade. Some snow plow operators may raise the lift arm such that the lower edge of the blade is disposed just above the underlying surface. But still the blade is subject to shock and wear because of irregularities and undulations in the underlying surface.

Therefore, there is a need for a snow plow control system that reduces the grinding action and resulting wear that takes place as the snow plow engages an underlying surface during the course of plowing snow.

SUMMARY OF THE INVENTION

The present invention relates to a snow plow having associated therewith a pneumatic or compressed air control system for reducing the effective weight of the snow plow when the snow plow is disposed in a lower snow plowing position.

In one embodiment, the pneumatic control system includes an air bladder or air springs that is operatively connected to a source of compressed air. The air bladder is also operatively associated with a lift arm that is, in turn, operatively connected to the snow plow. By pressurizing the air bladder, the air bladder expands and raises the lift arm, which in turn exerts an upward force on the snow plow, reducing its effective weight on the underlying surface. This reduces friction generated between the lower edge of the blade of the snow plow and the underlying surface and substantially reduces the wear on the blade of the snow plow.

In one particular embodiment, the air bladder or air springs is sandwiched between a lower lift arm and an upper lift arm. The lower lift arm is connected to a hydraulic cylinder, while the upper lift arm is operatively connected to the snow plow. By actuating the hydraulic cylinder, the snow plow can be raised from a lower snow plowing position to a raised travel position. That is, the hydraulic cylinder causes the lower lift arm to raise, which in turn engages the upper lift arm which results in the snow plow being raised. When the snow plow is disposed in the lower snow plowing position, the pneumatic bladder is pressurized by a compressed air source and this causes the upper lift arm to raise relative to the lower lift arm. Because the upper lift arm is operatively connected to the snow plow, this means that the upward movement of the upper lift arm results in an upward force being exerted on the snow plow, which effectively reduces the weight of the snow plow on the underlying surface.

Other objects and advantages of the present invention will become apparent and obvious from a study of the following description and the accompanying drawings which are merely illustrative of such invention.

DESCRIPTION OF EXEMPLARY EMBODIMENTS

Figure 1:
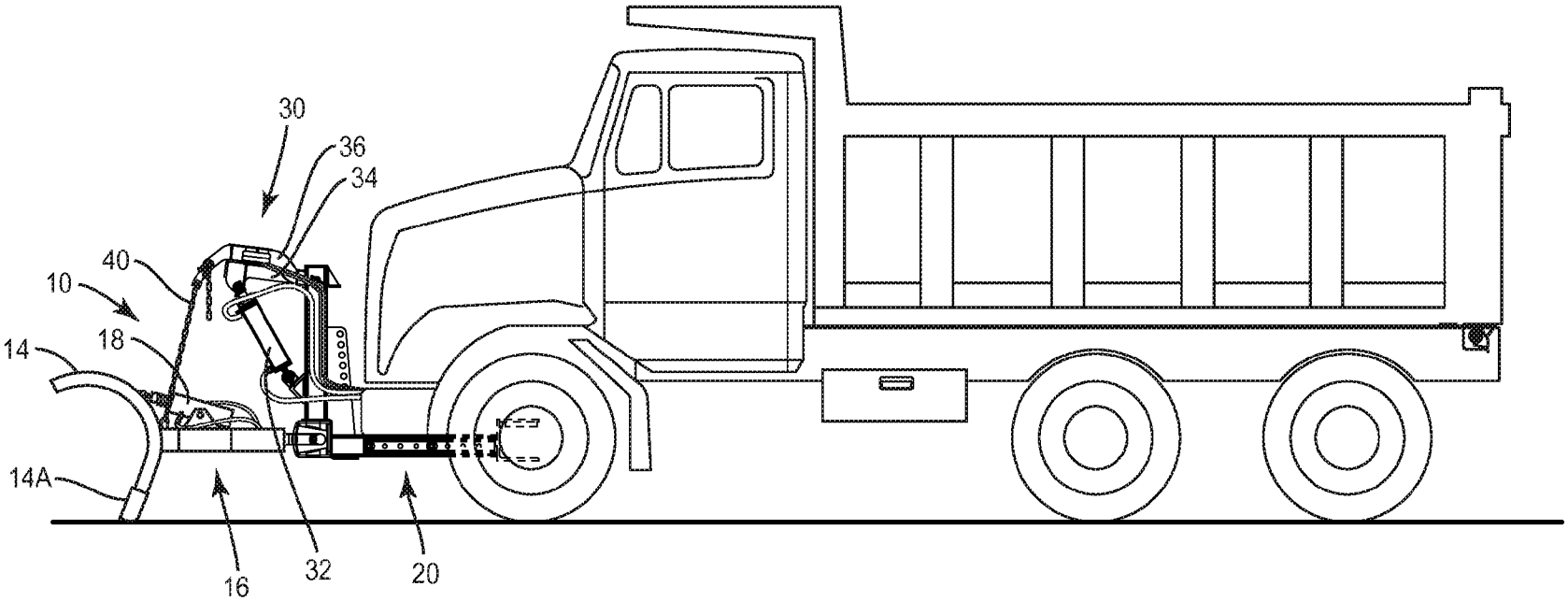
FIG. 1 is a side elevational view of the snow plow of the present invention attached to a truck.

With further reference to the drawings, particularly FIG. 1, the snow plow of the present invention is shown therein and indicated generally by the numeral 10. Snow plow 10 is secured to a truck 12 and projects forwardly therefrom. Snow plow 10 can assume various designs. An exemplary snow plow design is shown in the drawings, but it is understood and appreciated that the present invention can be incorporated and used in virtually all snow plow designs. Thus, a detailed description of the snow plow 10 is not dealt with herein because such snow plow designs are well known and appreciated by those skilled in the art. However, an overview of the snow plow 10 is presented. Snow plow 10 includes a blade 14 and a blade carrier frame indicated generally by the numeral 16. Blade 14 typically includes a moldboard with stiffeners. In addition, blade 14 includes a lower blade or cutting blade 14A that in operation typically engages an underlying surface such as a roadway. Also, in many conventional snow plow designs, there is provided a trip board secured to the lower edge of the moldboard that is spring loaded to release and pivot back when the snow plow engages an obstacle. In any event, one of the attributes and features of the present invention is that the snow plow is provided with a control system for reducing the effective weight of the snow plow on the underlying surface. By reducing the effective weight of the snow plow, the wear encountered by the lower blade or cutting blade 14A is substantially reduced.

The frame structure that supports the blade 14 is referred to herein as a blade carrier frame. Like the snow plow 10, the carrier frame 16 can vary. In the embodiment illustrated herein, the blade 14 is pivotally mounted to the carrier frame 16. A double-acting hydraulic cylinder 18 is mounted on the carrier frame 16 and is operatively connected to the blade 14. See FIG. 3. By actuating the hydraulic cylinder 18, an operator can adjust the angle of the blade 14 about a transverse axis that extends across the snow plow 10. Also, the blade carrier frame 16, in many snow plow designs, is provided with a reversing table that enables the angle of the blade 14 to be reversed. That is, from time-to-time, it is desirable to be able to vary the angle of the blade from a right side orientation to a left side orientation.

Figure 2:
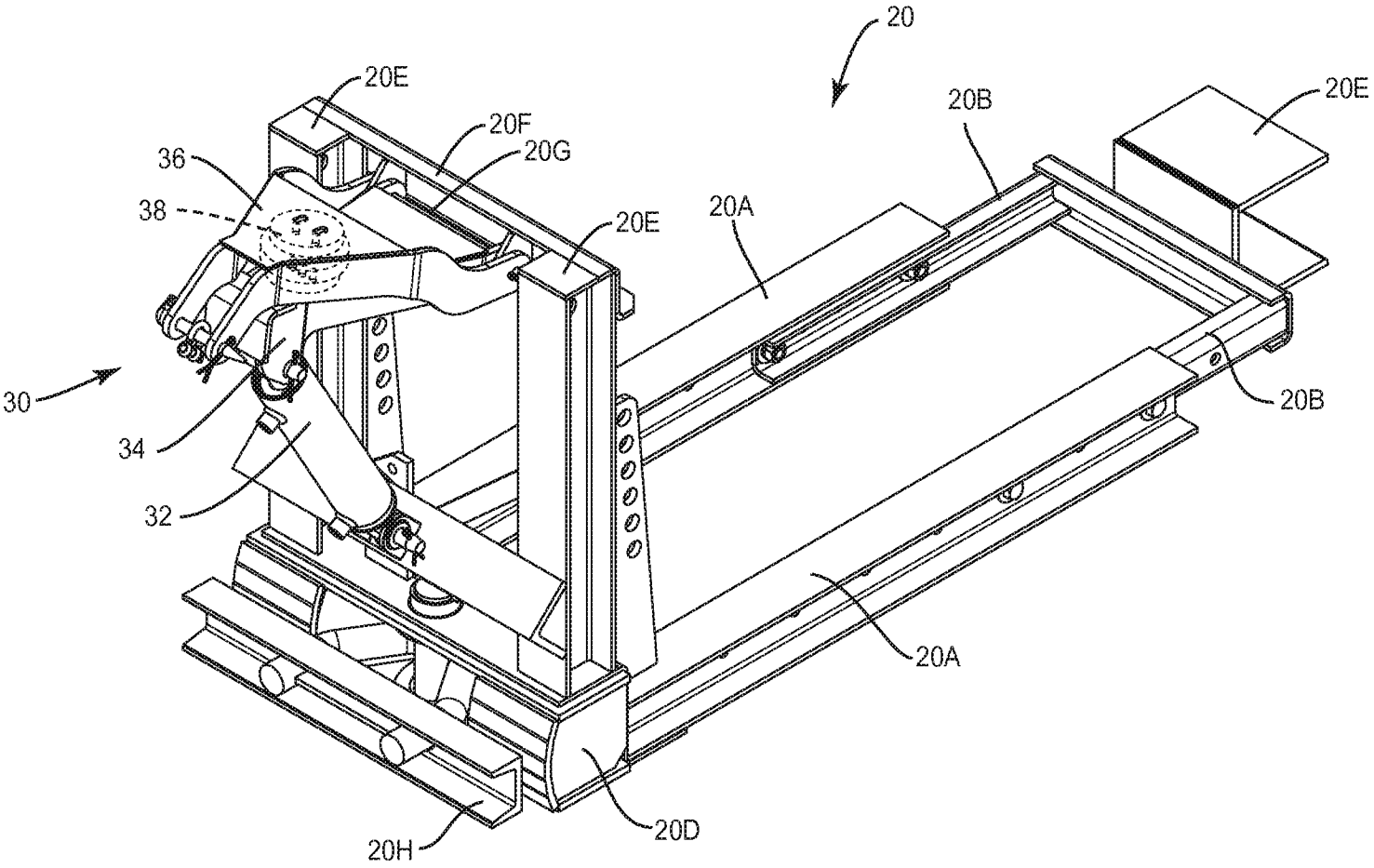
FIG. 2 is a perspective view showing a snow plow push frame having the pneumatic lifting device incorporated therein.

Snow plow 10 is moveably mounted to a push frame indicated generally by the numeral 20. In the embodiment illustrated herein, push frame 20 is attached to truck 12 and projects forwardly therefrom. Snow plow 10, in the embodiment illustrated, is pivotally connected to a front portion of the push frame 20. This enables the snow plow 10 to pivot up and down with respect to the push frame 20. In the drawings, one exemplary embodiment of a push frame is shown. See FIG. 2. It is appreciated by those skilled in the art that there are many different push frame designs that enable a snow plow to be secured to a vehicle, tractor or other prime mover. The present invention is designed to be employed with any snow plow or push frame design. Although the design of the push frame 20 may vary, it may be beneficial to briefly review the structure and function of the push frame 20 that is disclosed herein. With reference to FIG. 2, the push frame 20 comprises a pair of main beams 20A. There is also provided a pair of extension beams 20B that are adjustable with respect to the main beams 20A in order to accommodate different vehicles. At the end of the extension beams 20B, there is provided a cross-member and a U-shaped member 20C secured to the cross-member. U-shaped member 20C is designed to encompass or surround a portion of the front axle of the truck 12 in the embodiment illustrated herein.

Disposed about the front portion of the push frame 20 is a front lift frame. The front lift frame includes a base 20D and a pair of spaced apart column supports 20E projecting upwardly from the base. There is a cross-member 20F that extends across the upper portions of the column supports 20E. A transverse shaft 200 is mounted in the upper portions of the column supports 20E and extends transversely across an upper portion of the front lift frame. Disposed about the front lower portion of the push frame 20 is a coupler 20H. Details of the coupler are not dealt with herein because such is not per se material to the present invention and such couplers are well known and appreciated by those skilled in the art. Coupler 20H is designed to be attached to the snow plow 10 in such a manner that the snow plow is moveable up and down with respect to the push frame 20.

Figure 3:
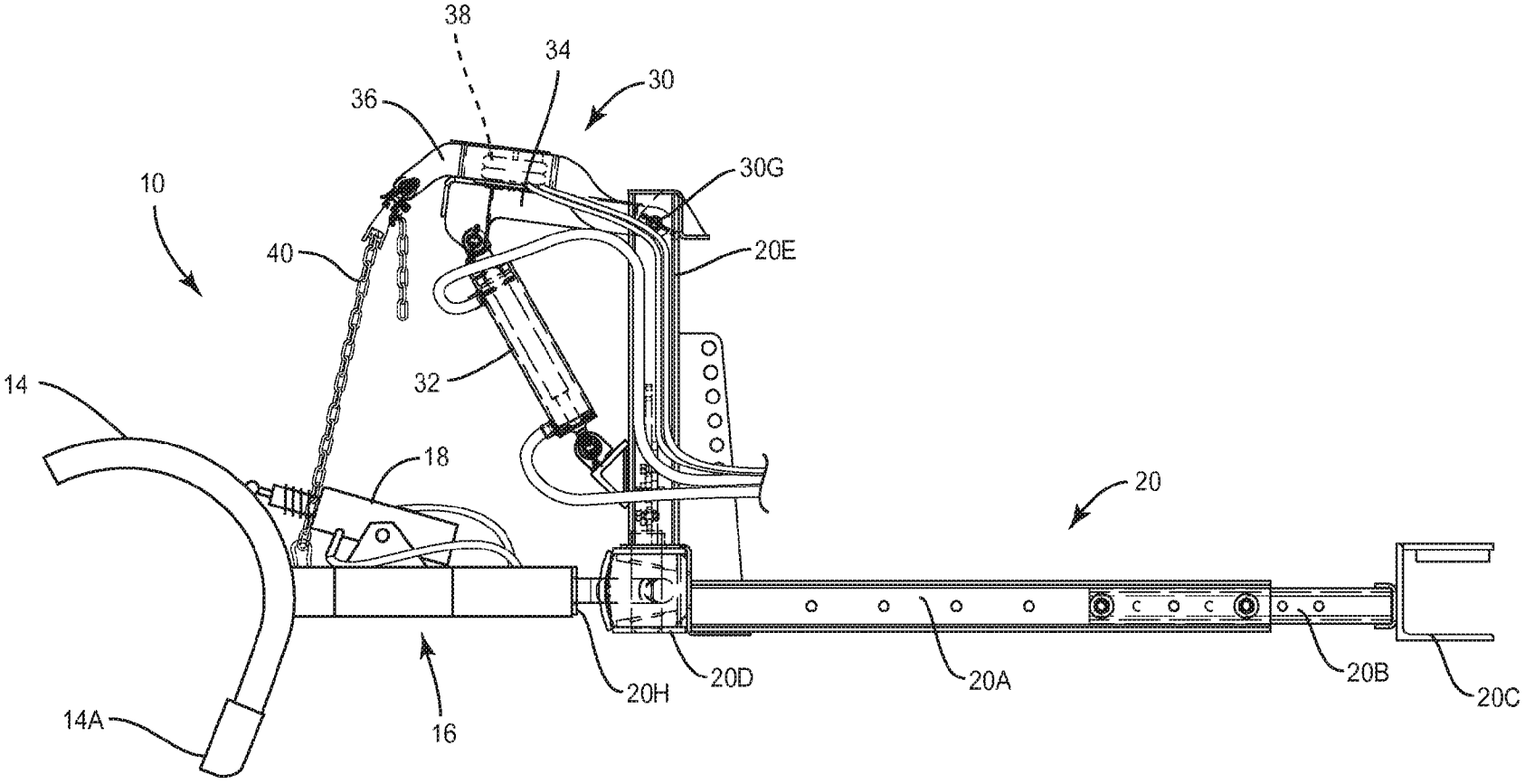
FIG. 3 is a side elevational view of the snow plow attached to a push frame.

As shown in FIGS. 1-3, a snow plow lift system is mounted to the front of push frame 20. The snow plow lift system is indicated generally by the numeral 30 and shown in detail in FIG. 2. Generally, the snow plow lift system includes a hydraulic system for raising and lowering the snow plow 10. As will be described subsequently herein, the hydraulic system is primarily responsible for raising and lowering the snow plow 10 between a lower snow plowing position and a raised travel position. In addition to the hydraulic system, there is provided a pneumatic or compressed air control system for reducing the effective weight of the snow plow 10 on an underlying surface such as a roadway. In particular, as will be discussed below, the pneumatic control system is operative when the snow plow assumes a lower snow plowing position to exert an upward force on the snow plow. This upward force effectively reduces the weight of the snow plow 10 and reduces the force and resulting friction from the lower edge of the blade 14 engaging the underlying surface during a snow plowing operation.

In one embodiment, these two systems can be consolidated to a degree. However, it should be pointed that in a preferred embodiment, the pneumatic control system for reducing the weight of the snow plow 10 works and operates independently of the hydraulic control system. Expressed in another way, in a preferred embodiment, the hydraulic control system is used for raising and lowering the snow plow 10 but is not utilized in controlling the weight of the snow plow when plowing snow.

With particular reference to FIGS. 1-3, there is provided a double-acting hydraulic cylinder 32 that is mounted on the front lift frame of the push frame 20. The hydraulic cylinder 32 includes a rod end that is pivotally connected to an outer end of a first lift arm 34. The first lift arm 34 is also referred to as a lower lift arm and is pivotally connected to the transverse shaft 200 extending across the upper portion of the front lift frame. It should be pointed out that the hydraulic cylinder 32 can be operatively integrated into various hydraulic systems. In one embodiment, the truck 12 may include its own hydraulic system and the hydraulic cylinder 32 described herein can be appropriately integrated into the hydraulic system of the truck 12.

Figure 4C:
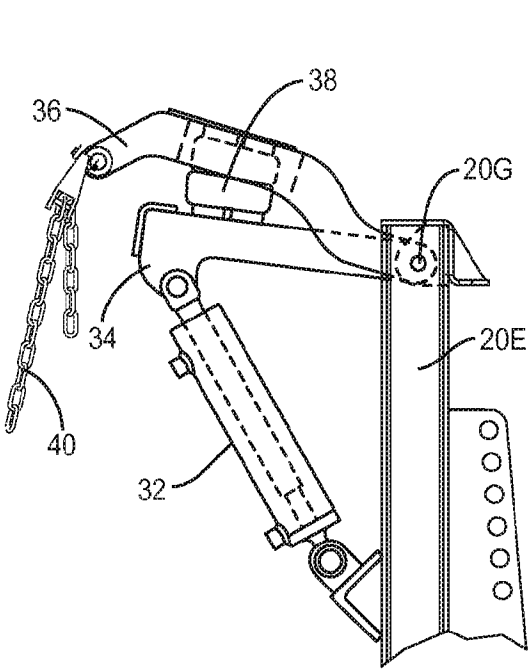
FIG. 4C is a view similar to FIGS. 4A and 4B but with the lower lift arm disposed in the lower position and the upper lift arm being disposed in an intermediate position.

Overlying the first lift arm 34 is a second or upper lift arm 36. The second lift arm 36 is also pivotally connected to the transverse shaft 20. See FIGS. 4A-4C.

Sandwiched between the first and second lift arms 34 and 36 is a pneumatic or air bladder 38. Pneumatic bladder 38 is sometimes referred to as an air spring. As used herein, the terms "air spring", "pneumatic bladder", and "air bladder" are interchangeable terms and mean the same. The pneumatic bladder 38 is extendable and retractable. This is accomplished by directing a system of compressed air into the air bladder 38 which will have the effect of causing the air bladder to extend or expand. Details of the air bladder or air springs 38 are not dealt with herein because air springs are well known and appreciated in the prior art. Generally, however, air springs or air bladders are employed through the use of an air compressor which fills and empties the pliable air bladder that forms the air springs. The load is usually not distributed to the rubber liner which only serves to contain the air. The weight is typically carried by a piston or a bead plate which is directly supported by the air in the bladder. Again, it should be stated that various types of air springs or pneumatic bladders can be employed in connection with controlling the weight of the snow plow when the snow plow assumes the lower snow plowing position. More particularly, the pneumatic bladder 38 is supported on the first lift arm and extends therefrom to where it directly or indirectly engages the upper lift arm 36. Therefore, it is appreciated that directing compressed air into the pneumatic bladder 38 and increasing the pressure of the air would cause the air bladder to extend and, therefore in this case, causes the second or upper lift arm 36 to raise and move relative to the lower or first lift arm 34.

A connector 40 is connected to the outer terminal end portion of the upper lift arm 36. This connector 40 extends downwardly and connects to the snow plow 10. Thus, it is appreciated that raising the upper lift arm 36 will result in the snow plow 10 being raised. Likewise, lowering the upper lift arm 36 will result in the snow plow 10 being lowered.

Figure 1A:
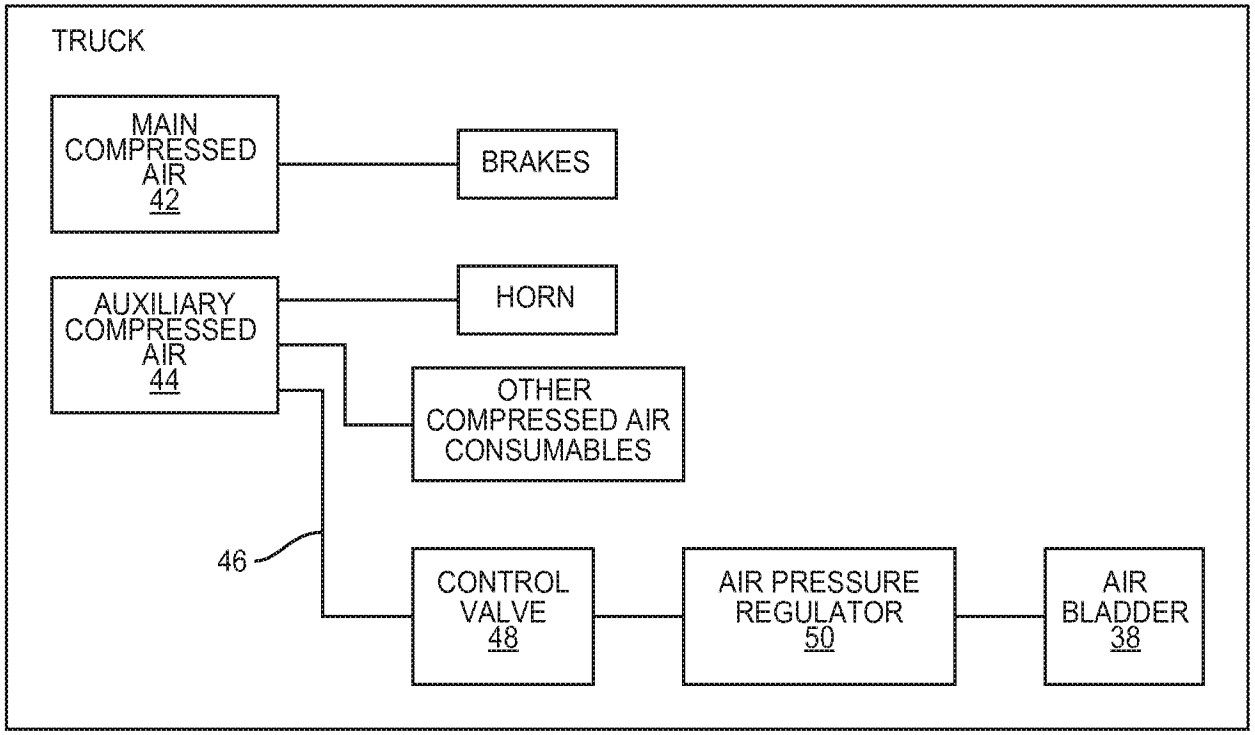
FIG. 1A is a schematic drawing illustrating the compressed air sources on the truck.

As discussed above, the air bladder 38 is powered by compressed air. The air bladder 38 may be connected to various sources of compressed air. In the exemplary embodiment illustrated herein, the air bladder 38 is powered by a compressed air source from the truck 12. As shown in FIG. 1A, the truck 12, in this example, includes two separate sources of compressed air. There is a main compressed air source 42 that is employed to power the brakes of the truck. There is an auxiliary or supplemental compressed air source 44 that is used to power or drive other compressed air consumables on the truck. For example, the auxiliary compressed air source 44 is used to power the horn of the truck. In the exemplary design disclosed herein, the auxiliary compressed air source 44 on the truck 12 is employed to power the pneumatic bladder or air springs 38. As seen in FIG. 1A, a compressed air line 46 leads from the auxiliary compressed air source 44 to a main on/off valve 48. Downstream of the on/off valve 48 is an air pressure regulator 50. Downstream of the air pressure regulator 50 is the air bladder or air springs 38. It should be pointed out that the on/off valve 48, as well as the air pressure regulator 50, can be located in various locations. In one exemplary embodiment, both the on/off valve 48 and the air pressure regulator 50 is disposed in the cab of the truck 12 where they can be easily accessed by the operator.

Figure 4B:
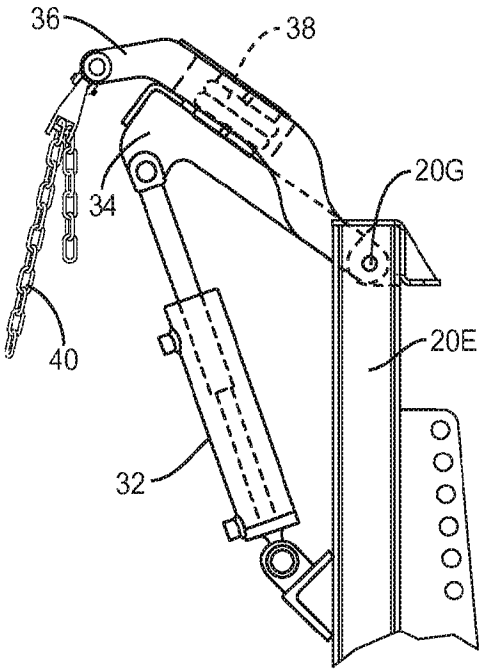
FIG. 4B is a view similar to FIG. 4A but showing the lift arms in an upper position.
Figure 4A:
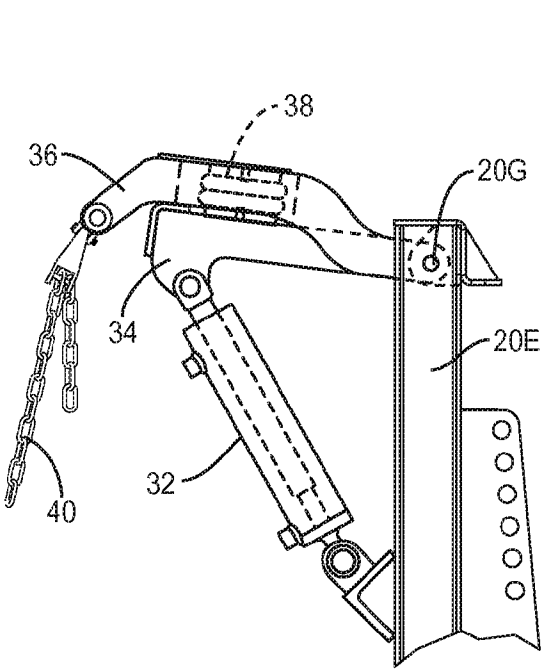
FIG. 4A is a side elevational view for a pneumatic bladder sandwiched between the first and second lift arms with the lift arms being disposed in a lower position.

FIG. 4A illustrates a mode of operation where the snow plow 10 is disposed in a lower snow plowing position. In this mode, the rod of the hydraulic cylinder 32 is retracted and the first or lower lift arm 34 is disposed in its lowermost position. The air bladder 38 is generally collapsed and the upper or second lift arm 36 is supported and engaged with the lower lift arm 34. As stated before, this results in the snow plow 10 being disposed in its lower snow plowing position and the lower edge of the blade 14A is engaged with the underlying surface or at least very close to the underlying surface.

During a snow plowing operation, the present invention envisions reducing the effective weight of the snow plow 10 in order to reduce the wear on the lower edge of the blade 14A of the snow plow. This is achieved by pressurizing the air bladder 38. See FIG. 4C. Note that the lower lift arm 34 remains in its lowermost position. By directing pressurized air into the air bladder 38, this causes the upper lift arm 36 to raise with respect to the lower lift arm 34. Because the upper lift arm 36 is connected to the snow plow 10 via the flexible connectors 40, it follows that, by inflating and expanding the air bladder 38, the upper lift arm 36 at least indirectly exerts a lifting force on the snow plow 10 while it is in the lower snow plowing position. The idea here is to reduce the effective weight of the snow plow bearing against the underlying surface. That is, the concept here is to provide a condition that effectively reduces the force of the snow plow on the underlying surface. Effectively, a portion of the weight of the snow plow is being transferred to the air bladder 38. For example, assume that a snow plow has a weight in the range of 1,000-1,500 lbs. By energizing the air bladder 38 and providing a lifting force on the snow plow, the effective weight of the snow plow, in one example, can be reduced to approximately 300-500 lbs. This will make a substantial difference in the resulting wear on the lower edge of the blade 14. It will be appreciated that, by employing the air pressure regulator 50, the amount of upward lifting force applied to the snow plow 10 can be varied.

The snow plow lifting system, shown and described above, can be utilized to raise the snow plow 10 from the lower snow plowing position to a raised travel position. This is illustrated in FIG. 4B. Prior to raising the snow plow 10 to the upper travel position, the air bladder 38 is deflated, causing the upper lift arm 36 to move downwardly into engagement with the lower lift arm 34. This is the position shown in FIG. 4A. Now the hydraulic cylinder 32 can be extended, as shown in FIG. 4B, and this results in the snow plow 10 being raised to the upper travel position.

There are many advantages to the pneumatic control system discussed above and shown in the drawings. First, the pneumatic control system is simple and relatively inexpensive to employ. It does not employ complicated and expensive hydraulic components and hydraulic circuitry. A further advantage of the pneumatic or compressed air control system over a hydraulic system is that hydraulics are rigid and do not have the flexibility or shock absorbing properties of an air system. This causes inefficiencies in the hydraulics as the hydraulics try to keep up with varying road surface changes, which uses engine horsepower and unnecessarily works the hydraulic system. With the pneumatic control system disclosed herein, it is easy to use the pressure regulator 50 to dial in the amount of blade weight on the underlying surface. As discussed above, the pressure regulator 50 and the main on/off control valve 48 is located in the truck cab convenient to the operation. Hydraulic systems do not have that advantage. In addition, the pneumatic system disclosed herein is easy to retrofit and adapt to existing snow plows. Overall, the pneumatic system results in less friction between the blade of the snow plow and the underlying surface, and in the end, is flexible and forgiving.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A snow removing apparatus configured to mount to a push frame attached to a vehicle, the snow removing apparatus comprising:

a snow plow including a blade adapted to engage an underlying surface when the snow plow assumes a snow plowing position;

first and second lift arms adapted to be mounted to the push frame and wherein the first and second lift arms are disposed one over the other;

the second lift arm being operatively connected to the snow plow for raising and lowering the snow plow between the snow plowing position and a raised travel position;

a hydraulic actuator operatively connected to the first lift arm;

a pneumatic bladder sandwiched between the first and second lift arms and configured to be operatively connected to a source of compressed air, the pneumatic bladder being expandable and retractable between the first and second lift arms such that the first and second lift arms move relative to each other when the pneumatic bladder expands and retracts;

wherein the hydraulic actuator is operative to raise and lower the snow plow between the snow plowing position and the raised travel position by raising and lowering the first lift arm which in turn is operative to raise and lower the second lift arm that is operatively connected to the snow plow; and an air pressure regulator configured to receiving compressed air from the source of compressed air and operatively associated with the pneumatic bladder for controlling the air pressure within the pneumatic bladder, and wherein when the snow plow is in the snow plowing position and the air pressure regulator increases the air pressure within the pneumatic bladder, the pneumatic bladder expands and raises the second lift arm relative to the first lift arm which exerts a lifting force on the snow plow and reduces the effective weight of the snow plow on the underlying surface, and wherein when the air pressure regulator decreases the air pressure in the pneumatic bladder, the pneumatic bladder retracts, resulting in the second lift arm lowering towards the first lift arm and increasing the effective weight of the snow plow on the underlying surface.

2. The snow removing apparatus of claim 1 wherein the first and second lift arms are pivotally mounted about the same axis.

3. The snow removing apparatus of claim 1 wherein the pneumatic bladder is seated on the first lift arm and extends upwardly therefrom and engages the second lift arm and wherein the expansion of the pneumatic bladder causes the first and second lift arms to move away from each other, and wherein the retraction of the pneumatic bladder causes the first and second lift arms to move towards each other.

4. The snow plowing apparatus of claim 1 including the vehicle and wherein the vehicle includes a main compressed air source and an auxiliary compressed air source wherein the auxiliary compressed air source of the truck forms said source of compressed air; and wherein there is an on-off control valve connected between the auxiliary compressed air source and the air pressure regulator.

5. The snow removing apparatus of claim 1 wherein the first and second lift arms are pivotally mounted about the same axis; and wherein the pneumatic bladder engages the first and second lift arms and causes the second lift arm to raise relative to the first lift arm in response to the pneumatic bladder expanding; and wherein the second lift arm moves down with respect to the first lift arm in response to the pneumatic bladder retracting.

6. The snow removing apparatus of claim 1 wherein the pressure regulator is operatively connected between an auxiliary compressed air source of a vehicle and the pneumatic bladder for controlling the air pressure in the pneumatic bladder.

7. The method of claim 4 wherein the snow plow is connected to a truck having a main compressed air source operatively connected to brakes of the truck and an auxiliary compressed air source, and wherein the method includes operatively connecting the auxiliary compressed air source of the truck to the pneumatic bladder and employing compressed air from the auxiliary compressed air source of the truck to actuate the pneumatic bladder.

8. A method of reducing the effective weight of a snow plow when the snow plow assumes a snow plowing position and a blade of the snow plow engages an underlying surface wherein the snow plow is mounted to a push frame and there is provided first and second lift arms that overlie each other and a pneumatic bladder sandwiched between the first and second lift arms, the method comprising:

raising the snow plow from the snow plowing position to a raised travel position by actuating a hydraulic cylinder that is operatively connected to the first lift arm and which raises the first lift arm which in turn raises the pneumatic bladder and the second lift arm which is operatively connected to the snow plow;

lowering the snow plow from the raised travel position to the snow plowing position by actuating the hydraulic cylinder and moving the first lift arm downwardly, causing the pneumatic bladder and the second lift arm and the snow plow to move downwardly;

when the snow plow assumes the snow plowing position, reducing the effective weight of the snow plow on the underlying surface by directing compressed air from a compressed air source through an air pressure regulator and employing the air pressure regulator to increase the air pressure in the pneumatic bladder sandwiched between the first and second lift arms and causing the air bladder to expand and lift the second lift arm relative to the first lift arm wherein the second lift arm applies an upward force on the snow plow and reduces the effective weight of the snow plow on the underlying surface; and increasing the effective weight of the snow plow on the underlying surface by employing the air pressure regulator to direct compressed air from the pneumatic bladder, causing the pneumatic bladder to retract and the second lift arm to lower towards the first lift arm, resulting in the effective weight of the snow plow on the underlying surface increasing.

9. The method of claim 8 wherein the pneumatic bladder is seated on the first lift arm and extends upwardly therefrom and engages the second lift arm.

10. The method of claim 8 including pivoting the first and second lift arms about a common axis.

11. The method of claim 8 wherein the first and second lift arms are each pivotally mounted to the push frame; and wherein the method includes maintaining the first lift arm stationary when the pneumatic bladder is expanding which results in the pneumatic bladder engaging the second lift arm and raising the second lift arm relative to the stationary first lift arm; and wherein the method further includes maintaining the first lift arm stationary when the pneumatic bladder is retracting, which results in the second lift arm moving downwardly towards the stationary first lift arm as the pneumatic bladder retracts.

* * * * *